US012611565B2

(12) United States Patent
Choudhury et al.

(10) Patent No.: US 12,611,565 B2
(45) Date of Patent: Apr. 28, 2026

(54) WEIGHT PLATE

(71) Applicant: OMNIGEM LTD, West Midlands (GB)

(72) Inventors: Abdul Wajed Choudhury, West Midlands (GB); Charlie Conway, Worcestershire (GB); Alex Lee, Gloucestershire (GB); Charlie Meadows, Gloucestershire (GB)

(73) Assignee: OMNIGEM LTD, West Midlands (GB)

( * ) Notice: Subject to any disclaimer, the term of this patent is extended or adjusted under 35 U.S.C. 154(b) by 55 days.

(21) Appl. No.: 18/171,577

(22) PCT Filed: Aug. 16, 2021

(86) PCT No.: PCT/GB2021/052117
§ 371 (c)(1),
(2) Date: Feb. 20, 2023

(87) PCT Pub. No.: WO2022/038341
PCT Pub. Date: Feb. 24, 2022

(65) Prior Publication Data

US 2024/0285996 A1 Aug. 29, 2024

(30) Foreign Application Priority Data

Aug. 21, 2020 (GB) ..... 2013047

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0726* (2013.01); *A63B 21/0728* (2013.01)

(58) Field of Classification Search
CPC ..... A63B 21/0728; A63B 21/0724; A63B 21/0726; A63B 21/00065; A63B 23/12; A63B 21/072–075
See application file for complete search history.

(56) References Cited

U.S. PATENT DOCUMENTS 850,964 A * 4/1907 Pelletier ..... A63B 21/075 482/108
3,785,646 A 1/1974 Ruskin
(Continued)

FOREIGN PATENT DOCUMENTS

CN 101991931 A 3/2011
CN 205268891 U * 6/2016
(Continued)

OTHER PUBLICATIONS

Translation of CN-205268891-U (Year: 2016).*
(Continued)

*Primary Examiner* — Megan Anderson
*Assistant Examiner* — Catrina A Letterman
(74) *Attorney, Agent, or Firm* — Yee & Associates, P.C.

(57) ABSTRACT

A plate (5, 5*a*, 5*b*) for a dumbbell or barbell (1), the plate (5, 5*a*, 5*b*) comprising a body (17), the body (17) comprising: one or more primary weight portions (35*a*, 35*b*) extending in a direction radially out from a plate axis (23) passing through a centre point (25) of the plate (5, 5*a*, 5*b*), the primary weight portions (35*a*, 35*b*) forming at least part of a total weight of the plate (5, 5*a*, 5*b*); one or more additional weight portions (57*a*, 57*b*) removably connectable to the body (17), such that connecting and disconnecting the additional weight portions (57*a*, 57*b*) incrementally varies the total weight of the plate (5, 5*a*, 5*b*).

20 Claims, 6 Drawing Sheets

(56) References Cited

U.S. PATENT DOCUMENTS

| | | | | |
|---|---|---|---|---|
| 4,384,714 | A | 5/1983 | Kimura | |
| 4,515,364 | A | 5/1985 | Rotella | |
| 5,464,379 | A | 11/1995 | Zarecky | |
| 6,315,699 | B1 | 11/2001 | Romero | |
| 2004/0067826 | A1 | 4/2004 | Elledge | |
| 2007/0298938 | A1 | 12/2007 | Greenberg et al. | |
| 2009/0048079 | A1* | 2/2009 | Nalley | A63B 21/0728 482/107 |
| 2010/0248913 | A1* | 9/2010 | Dickerson | A63B 21/075 482/104 |
| 2011/0245048 | A1* | 10/2011 | Nalley | A63B 21/0615 482/107 |
| 2012/0225758 | A1 | 9/2012 | Shaw | |
| 2013/0231225 | A1* | 9/2013 | Shozda | A63B 21/075 482/108 |
| 2014/0031177 | A1* | 1/2014 | Wang | A63B 21/075 482/107 |
| 2015/0258412 | A1* | 9/2015 | Doerr | A63B 21/00065 482/92 |
| 2016/0101312 | A1* | 4/2016 | Yusufov | A63B 21/075 482/106 |
| 2017/0274240 | A1* | 9/2017 | Pong | A63B 21/4035 |
| 2020/0094100 | A1* | 3/2020 | Garcia Castillo | A63B 21/0601 |
| 2021/0331022 | A1* | 10/2021 | Shao | A63B 21/0728 |
| 2022/0401786 | A1* | 12/2022 | Zhang | A63B 21/0728 |
| 2023/0372763 | A1* | 11/2023 | Pena | A63B 21/0728 |

FOREIGN PATENT DOCUMENTS

| | | | |
|---|---|---|---|
| CN | 206777685 | U | 12/2017 |
| CN | 211461921 | U | 9/2020 |
| GB | 2413288 | A | 10/2005 |

OTHER PUBLICATIONS

Intellectual Property Office (IPO) Search Report, dated Feb. 5, 2021, regarding Application No. GB20133047.2, 1 page.

PCT International Search Report and Written Opinion, dated Dec. 10, 2021, regarding Application No. PCT/GB2021/0521117, 13 pages.

* cited by examiner

WEIGHT PLATE

The present disclosure relates to a weight plate for a dumbbell or barbell.

Dumbbells and barbells are commonly used in both gyms and the home. Different training routines and different users may require the dumbbell or barbell to be different weights, and in some training routines, the weight may need to be changed rapidly between different exercises.

Typically, dumbbells or barbells are provided as a bar with a set of plates of different weights. The plates can be fixed on the bars by nuts. The nuts can screw onto the threaded end sections of the bar to hold the weights in place. Alternatively, spring clamps may be used. In either case, changing the weights can be time consuming and cumbersome as part of a training routine. Furthermore, a large number of plates are needed to provide different weights. This can take up space, and it is easy for weights to be lost or misplaced.

According to a first aspect of the invention, there is provided a plate for a dumbbell or barbell, the plate comprising a body, the body comprising: one or more primary weight portions extending in a direction radially out from a plate axis passing through a centre point of the plate, the primary weight portions forming at least part of a total weight of the plate; one or more additional weight portions removably connectable to the body, such that connecting and disconnecting the additional weight portions incrementally varies the total weight of the plate.

The additional weight portions may be arranged to be removably connectable to the body by latching points formed, at least in part, in the primary weight portions.

The body may comprise: a mounting portion defining a passage extending around the plate axis, for mounting the plate on a dumbbell or barbell bar, the one or more primary weight portions extending radially out from the mounting portion.

A radially inner rim of the one or more additional weight portions may abut the mounting portion.

The plate may comprise formations arranged to space the plate from an adjacent plate, in use.

The body may have a radially outer rim, the radially outer rim formed at least in part by the one or more primary weight portions and at least in part by the one or more additional weight portions.

The body may comprise, for each of the one or more additional portions, a void arranged to receive the additional portion, the void defined by the one or more primary weight portions.

Each additional portion may comprise a pair of opposing sidewalls; and wherein each additional portion is removably connectable to the one or more primary weight portions at both of the pair of opposing sidewalls.

The sidewalls may be arranged to extend radially out from the plate axis.

The body may comprise at least two primary weight portions spaced from each other around the plate axis, the voids formed in the spaces between the primary weight portions.

Each primary weight portion may comprise a pair of opposing sidewalls having a length extending radially out from the plate axis. For each void, a first radially extending edge of the void may be formed by a sidewall of a first primary weight portion, and a second radially extending edge of the void may be formed by a sidewall of a second primary weight portion, adjacent and spaced from the first.

Each void may have a width measured around the plate axis, between the opposing edges of the void. Each primary weight portion may have a width measured around the plate axis, between the opposing sidewalls of the primary weight portion. The voids may have the same width as each other. The primary weight portions may have the same width as each other.

The width of the voids may be the same as the width of the primary weight portions.

The body may comprise a pair of primary weight portions arranged on opposing sides of the plate axis, and a pair of voids arranged on opposing sides of the plate axis, between the anchor portions.

The plate may comprise a latching mechanism to removably connect the one or more additional portions to the body, the latching mechanism comprising: one or more catch members, and a corresponding passage to receive the catch member, the catch member and passage forming a latching point, the plate optionally comprising biasing means to urge the catch member to remain in the passage.

The catch member may be provided in a hollow section formed in a primary weight portion or an additional weight portion, and may project out of an opening to engage the passage. The primary weight portion or additional weight portion having the catch member also may comprise solid sections to provide weight.

The catch member may move into and out of the passage in a first direction along its length, the first direction perpendicular to the plate axis.

The passage may have a height extending perpendicular to the first direction. The height of the passage may be larger than the catch member, to accommodate relative movement of the additional portion and anchor portion.

The plate may further comprise locating means arranged to locate the one or more additional weight portions relative to the one or more primary weight portions, the locating means comprising a shoulder extending from one of the primary weight portion and the additional weight portion, and a socket for receiving the shoulder in the other of the primary weight portion and the additional weight portion.

The plate may comprise handles arranged to actuate the catch members, the handles formed on a radially outer edge of the additional weight portions or primary weight portions.

The handles may be formed in recesses extending radially inwards from the radially outer edge of the additional weight portions or primary weight portions.

The one or more additional weight portions may increase the total weight of the plate by up to 100% compared to the weight of the primary weight portions.

According to a second aspect of the invention, there is provided a dumbbell or barbell kit comprising: one or more pairs of plates according to the first aspect, each plate in the same pair being the same weight; and a bar for mounting the plates on, wherein the plate axis of the plates extends along the bar.

The kit may comprise at least two pairs of plates, each plate in the same pair being the same weight, and each plate in different pairs having different plates. Each plate may have a thickness along the plate axis and a radius extending from the plate axis. All plates of the at least two pairs of plates may have the same radius. Different pairs of plates may have different thicknesses.

A projection may extend radially into the passage of the mounting portion, the projection extending from one of the mounting portion or the bar, and the other of the mounting portion or the bar including a corresponding groove. The projection may be discontinuous around the plate axis, and the groove may extend along the plate axis, such that engagement of the projection and groove prevents rotation of the plate around the axis.

According to a third aspect of the invention, there is provided a dumbbell or barbell kit comprising: one or more pairs of plates, each plate in the same pair being the same weight; and a bar for removably mounting the plates on, the plates including a passage for mounting the plates on the bar. A projection may extend radially into the passage of the plate, the projection extending from one of the plate or the bar, and the other of the plate or the bar including a corresponding groove. The projection may be discontinuous around the plate axis, and the groove may extend along the plate axis, such that engagement of the projection and groove prevents rotation of the plate around the axis.

The skilled person would understand that features described with respect to one aspect of the invention may be applied, mutatis mutandis, to the other aspects of the invention.

According to various embodiments of the invention, the weight of the plate can be changed by simply adding or removing additional weight portions, and without removing the plate from the bar. According to at least some embodiments, this also reduces the total number of plates in a set that may be needed to provide a wide range of possible weights. This makes storage easier, and makes it less likely for plates to be lost or misplaced.

Embodiments of the invention will now be described, by way of example only, with reference to the accompanying drawings, in which.

Figure 1:
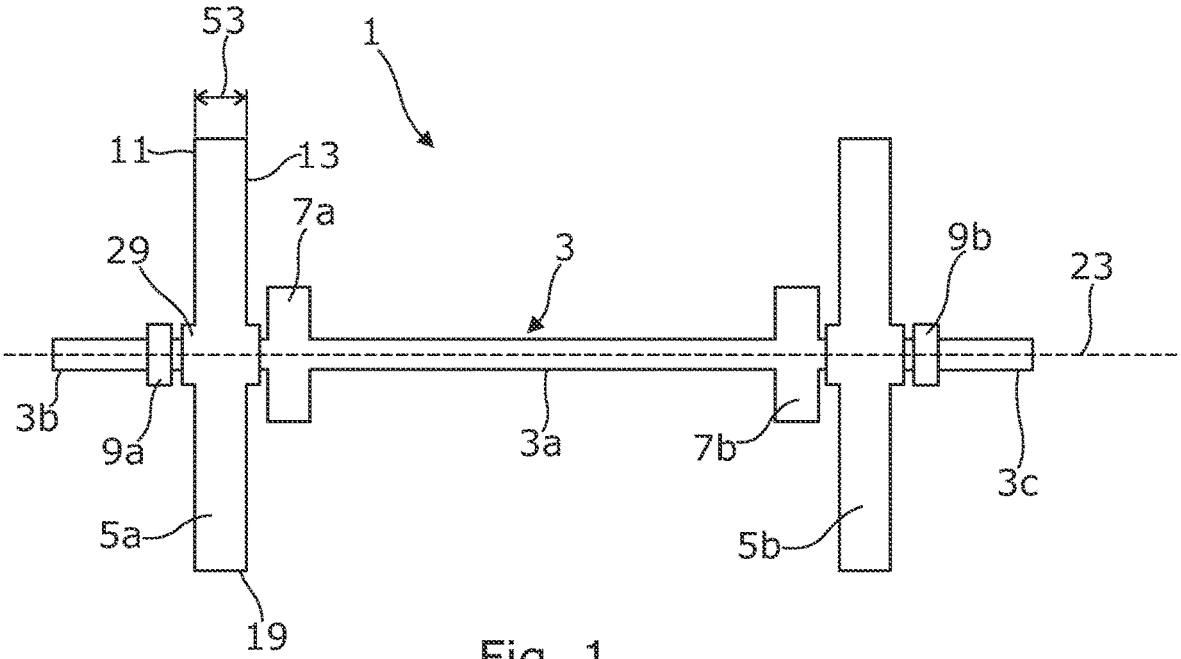
FIG. 1 illustrates a dumbbell or barbell according to an embodiment of the invention.

FIG. 1 illustrates a dumbbell or barbell 1 according to an embodiment of the invention. It will be appreciated that the below discussion can equally apply to a dumbbell or barbell 1. It will be appreciated that in the following description, reference to either one of a dumbbell or barbell can be taken as a reference to both.

The dumbbell 1 comprises an elongate bar 3 on which plates 5*a*, 5*b* can be mounted to provide weight. The bar 3 comprises a centre portion 3*a* for a user to grip, and end portions 3*b*, 3*c* on which the plates 5*a*, 5*b* are mounted. At each end portion 3*b*, 3*c* an enlarged collar or flange 7*a*, 7*b* extends radially out from the bar 3. The collars or flanges 7*a*, 7*b* act as a stop to prevent the plates 5*a*, 5*b* encroaching on the centre portion 3*a* of the bar 3.

In one example, the plates 5*a*, 5*b* may be interchangeable, such that the weight of the dumbbell 1 can be varied. Typically, the plates 5*a*, 5*b* on each end portion 3*b*, 3*c* of the bar 3 are the same weight so the dumbbell 1 is balanced. Therefore, a dumbbell 1 is typically provided as a kit comprising a bar 3, and a number of different pairs of plates 5*a*, 5*b* of the same weight. The weight of the plates 5*a*, 5*b* varies between pairs.

The end sections 3*b*, 3*c* of the bar 3 may be threaded. Nuts 9*a*, 9*b* having corresponding threads can be tightened onto the threaded end sections 3*b*, 3*c* such that the plates 5*a*, 5*b*, are securely held between the collars 7*a*, 7*b* and nuts 9*a*, 9*b*. In an alternative example, spring clamps (not shown) may be used instead of nuts 9*a*, 9*b*.

The person skilled in the art will appreciate that there are various alternative arrangement for securing the plates 5*a*, 5*b* to the bar 3 that may also be used, and the end sections 3*b*, 3*c* of the bar 3 do not necessarily need to be threaded for some of these arrangements.

Figure 2:
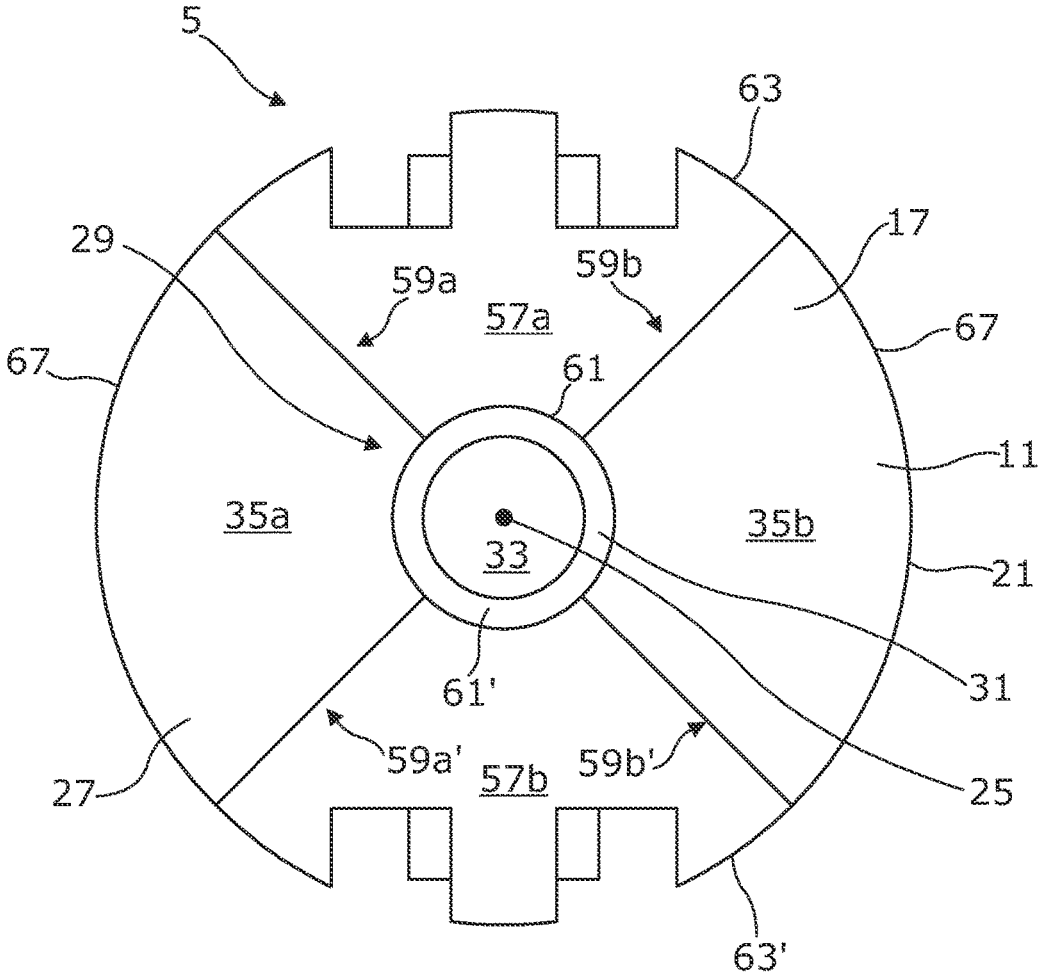
FIG. 2 illustrates one of the plates of the dumbbell or barbell shown in FIG. 1, showing a front surface.

FIG. 2 illustrates an example of a plate 5 for mounting on an end portion 3*b*, 3*c* of the dumbbell shown in FIG. 1.

In the example shown, the plate 5 is formed of a substantially disc shaped body 17. An axis 23 of the plate 5 extends through a centre point 25 of the body 17, in a direction perpendicular to the body 17. Thus, in the dumbbell 1, the plate axis 17 extends along the bar 3.

With reference to FIGS. 1 and 2, the body 17 has a planar front surface 11, perpendicular to the plate axis 23, and an opposing planar rear surface 13, spaced from and parallel to the front surface 11. The front and rear surfaces 11, 13 are separated by a thickness 15 of the body 17, which is also a thickness of the plate 5. It will be appreciated that in one example, the front and rear surfaces 11, 13 are substantially identical, and so the plate 5 can be mounted with the front surface facing towards the centre of the bar 3 or the end of the bar 3.

An annular outer wall 19 extends parallel to the plate axis 23 around a radial outer rim 21 of the body 17, between the front and rear surfaces 11, 13.

With further reference to FIGS. 3A, 3B, 4 and 5, the body 17 of the plate 5 will now be described in more detail.

Figure 3A:
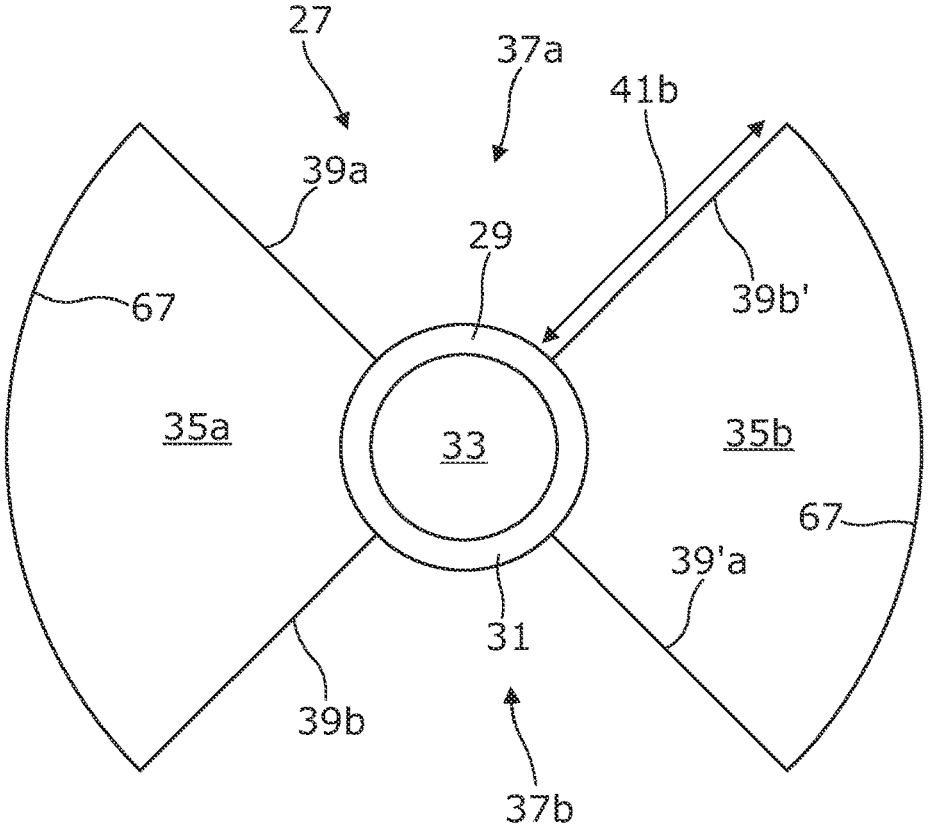
FIG. 3A illustrates a core portion of the body of the plate in FIG. 2, showing the front surface.
Figure 3B:
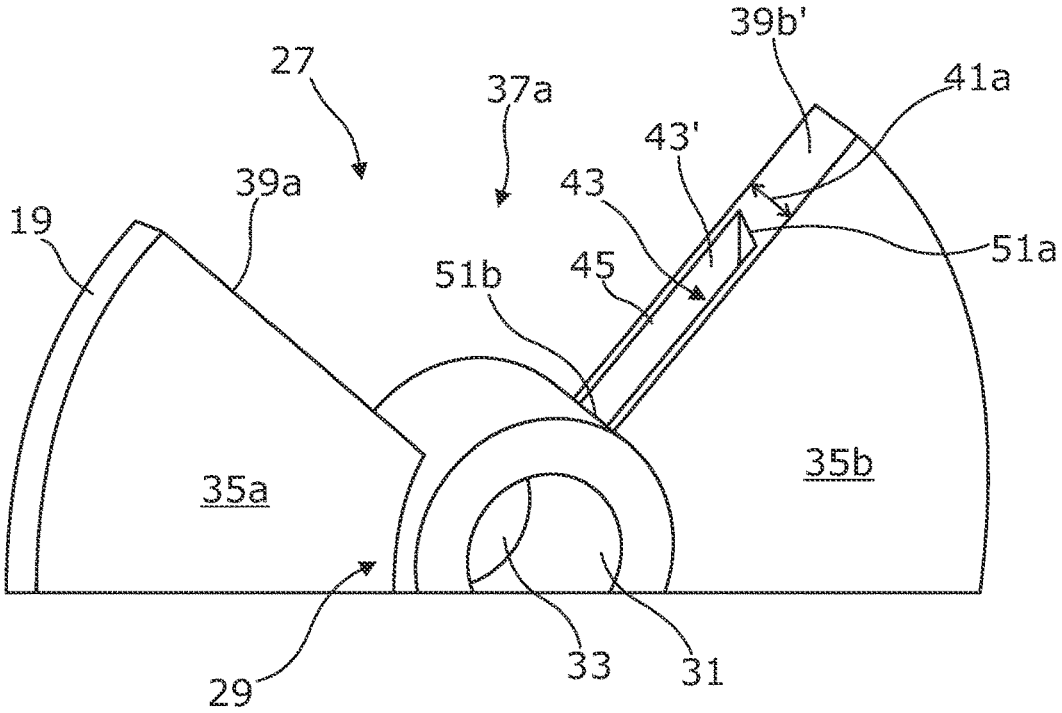
FIG. 3B illustrates the core portion of the body of the plate in FIG. 2, in perspective view.

The body 17 includes a core part 27, which is shown in more detail in FIGS. 3A and 3B. The core part 27 contributes a proportion of the overall maximum weight of the plate 5.

The core part 27 includes a mounting portion 29 arranged at the centre of the plate 5. The mounting portion 29 comprises an annular wall 31 extending round the plate axis 23 defining a passage 33 extending along the plate axis 23, from the front surface 11 to the rear surface 13. When the plate 5 is in use in the dumbbell 1, the bar 3 is passed through the passage 33 of the mounting portion 29. The passage 33 is sized to receive standard size bars 3 for dumbbell or barbell sets, such that the plate 5 may be used with any suitable bar 3. For example, the bar 3 may be 1 inch (2.54 cm) in diameter.

As best shown in FIG. 1 or 3B, the mounting portion 29 projects out from the front and rears surfaces 11, 13 of the plate 5 along the axial direction 23. This ensures that when, in use, multiple plates 5 are provided on the bar 3, the plates 5 are spaced from each other.

Two primary weight portions 35*a*, 35*b* extend radially out from the mounting portion 29 at diametrically opposed positions around the plate axis 35. The primary weight portions 35*a*, 35*b* are spaced from each other around the plate axis 23, such that the core part 27 of the body 17 has a "bow-tie" type shape. Between the primary weight portions 35*a*, 35*b*, voids 37*a*, 37*b* are formed.

The primary weight portions 35*a*, 35*b* each extend between the front surface 11 and rear surface 13 of the body 17. At a radially inner position, the primary weight portions 35*a*, 35*b* join to the mounting portion 29. The primary weight portions 35*a*, 35*b* then extend radially out to the outer rim 21.

Sidewalls 39*a*, 39*b*, 39*a*', 39*b*' extend radially out from the mounting portion 29 to the outer rim 21 at radial edges of each primary weight portion 35*a*, 35*b*. The sidewalls 39*a*, 39*b*, 39*a*', 39*b*' have a height 41*a* extending parallel to the plate axis 23, and a length 41*b* extending in the radial direction. The sidewalls 39*a*, 39*b*, 39*a*', 39*b*' form radial edges of the voids 37*a*, 37*b*.

In each of the sidewalls 39*a*, 39*b*, 39*a*', 39*b*' of the primary weight portions 35*a*, 35*b* a socket 43 is formed. The socket 43 comprises an aperture 45 in the sidewall 39*a*, 39*b*, 39*a*', 39*b*' that opens into an empty volume 43' formed within the primary weight portion 35*a*, 35*b*. Along the axial direction 23, the socket 43 is bounded by the front and rear surfaces 11, 13 of the plate 5, such that it is closed apart from the aperture 43.

In cross section perpendicular to the plate axis 23, the socket 43 has the shape of a right angle triangle, with the hypotenuse formed along the radial direction. Therefore the aperture 45 is along the hypotenuse.

A first wall 47 of the socket 43 extends from the radially outer end 51*a* of the aperture 45, and joins a second wall 49 at a right angle corner 53. The second wall 49 then extends to the radially inner end 51*b* of the aperture. In the example shown, the first and second walls are approximately the same length. The socket 43 has a height extending parallel to the plate axis 23. The height of the socket 43 is constant over its extend parallel to the front or rear surface 11, 13.

In the example shown, the aperture 45 forms an entire side of the socket 43, with the first and second walls 47, 49 forming the other sides. The radially inner end of the socket 51*b* is formed at the mounting portion 29, whilst the radially outer end 51*a* of the aperture 45 is formed spaced inwardly from the outer rim 21.

A blind passage 55 extends from the first socket wall 47, extending in a direction parallel to the second wall 49. The blind passage 55 opens into the socket, at the first socket wall 47 at one end and is closed at the other end. As will be discussed in more detail below, the passage is relatively narrow compared to the length of the first wall 47, and is provided partway between the radially outer end 51*a* of the socket and the corner 53 with the second wall 49

Away from the socket 43, the primary weight portion 35 is substantially solid, in order to provide weight to the plate 5.

The body 17 also includes a pair of additional weight portions 57*a*, 57*b*. The additional weight portions 57*a*, 57*b* are received in the voids 37*a*, 37*b* formed between the primary weight portions 35*a*, 35*b*.

Figure 4:
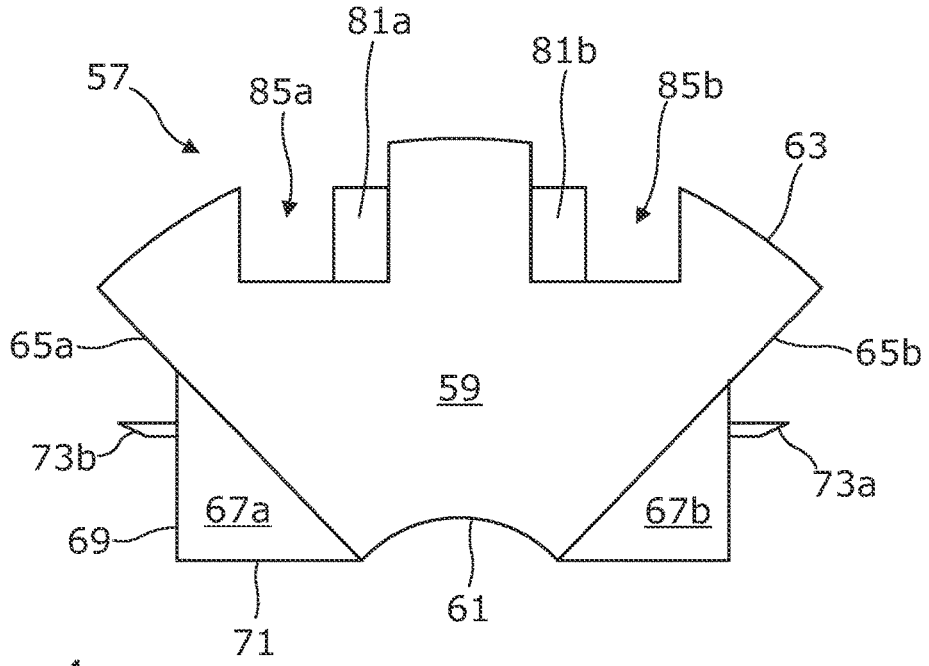
FIG. 4 illustrates an additional weight portion of the body of the in FIG. 2.

FIG. 4 shows one of the additional weight portions 57 in more detail. It will be appreciated that both additional weight portions 57*a*, 57*b* will have the same configuration.

The additional weight portion 57 has a central section 59. The central section 59 is formed in the shape of an annulus sector, having an inner rim 61, and an outer rim 63.

Radial sidewalls 65*a*, 65*b* extending between the inner rim 61 and outer rim 63 at the edges of the central section 59.

The central section 59 of the additional weight portion 57 is sized such that when the additional weight portion 57 is received in the corresponding void 37, the inner rim 61 of the central section 59 abuts the mounting portion 29 of the core 27 of the body 17 and the radial sidewalls 65*a*, 65*b* abut the sidewalls 39*a*, 39*b*, 39*a*', 39*b*' of the primary weight portions 35*a*, 35*b*.

When the additional weight portion 57 is received in the corresponding void 37, the outer rim 63 of the central section 59 also aligns with the radially outer rim 61 of the primary weight portions 35*a*, 35*b* to form the outer rim 21 of the boy 27 as a continuous circle.

The angle subtended by the central section 59 (i.e. the angular width of the additional weight portion 57) is the same as the angle subtended by the voids 37*a*, 37*b* in the core 27, and the thickness of the central section 59 along the axial direction 23 is the same as the core part 27. Therefore, when the additional weight portion 57 is received in the corresponding void 37, the central section 59 substantially fills the void 37*a*, 37*b* formed between two primary weight portions 35*a*, 35*b*. As such, when both additional weight portions 57*a*, 57*b* are received in the corresponding voids 37*a*, 37*b*, the body 17 forms a complete disc around the plate axis 23.

As best shown in FIG. 4, a pair of shoulders 67*a*, 67*b* are formed on the radial sidewalls 65*a*, 65*b* of the additional weight portion. The shoulders 67*a*, 67*b* have a shape and size to fit into the sockets 43 formed in the core part 27 of the body 17. As such, the shoulder 67*a*, 67*b* are right angle triangles in shape, with the hypotenuse formed by the sidewall 65*a*, 65*b* of the central section 59.

A first wall 69 of the shoulder 67*a*, 67*b* extends from the radially outer end of the shoulder 67*a*, 67*b*, and joins a second wall 71 at a right angle corner. The second wall 71 then extends to the radially inner rim 61 of the additional weight portion 57. In the example shown, the first and second walls 69, 71 are approximately the same length.

When the shoulder 67*a*, 67*b* is received in the socket 43, the first wall 47 of the socket is parallel to the first wall 69 of the shoulder 65*a*, 65*b*, and the second wall 49 of the socket is parallel to the second wall 71 of the shoulder 65*a*, 65*b*.

Along the plate axis 23, the shoulder 67*a*, 67*b* is narrower than the central section 59, and is spaced from the central section 59 on both the front and rear faces. Therefore, the shoulder 67*a*, 67*b* can slot into the socket 43 in the primary weight portion 35*a*, 35*b*.

The shoulder 67*a*, 67*b* helps to locate the additional weight portion 59 and at least partially holds it in place in at least the axial direction 23. The additional weight portion 57*a, b* is also latched to each of its neighbouring primary weight portions 35*a*, 35*b* at latching points along the radial edges of the void 37*a,b*.

The additional weight portion 57 includes catch members 73*a*, 73*b* that project from the shoulders 67*a*, 67*b* into the passage 55 formed in the first wall 47 of the socket 43.

The catch member 73 projects in a direction perpendicular to the first wall 69 of the shoulder 65*a*, 65*b*. The passage 55 and corresponding catch member 73 form a latching point.

Optionally, the catch member 73 may be slightly smaller than the passage 43 and/or the shoulder 65*a*, 65*b* may be slightly smaller than the socket 43—this allows for some relative movement of the primary weight portions 35*a*, 35*b* and additional weight portions 57*a*, 57*b*, for example, when the plate 5 is dropped. However, the additional weight portions 57*a*, 57*b* are held securely in place by the catch members 73*a*, 73*b* and shoulder 67*a*, 67*b*.

Figure 5:
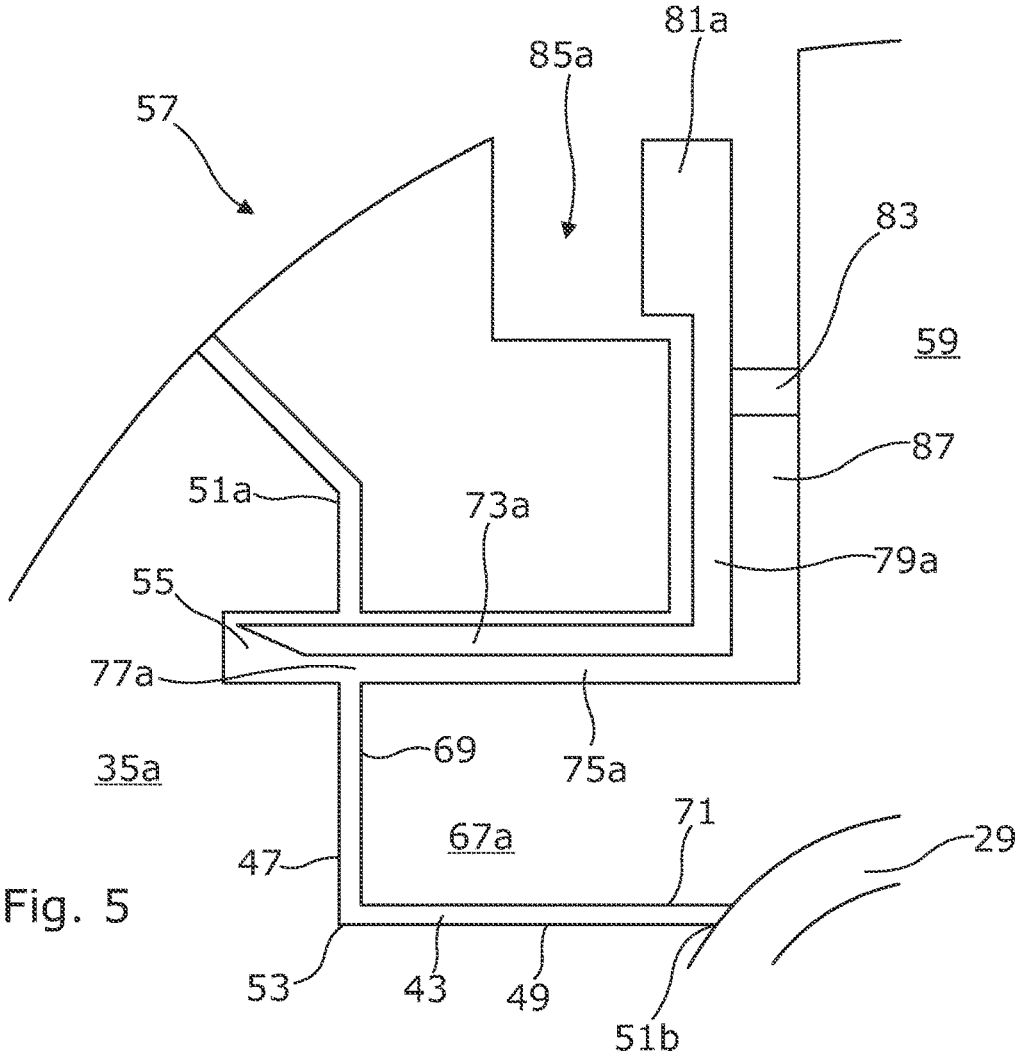
FIG. 5 illustrates the plate of FIG. 2, in sectional view, in the region of a catch and socket between the core portion and the additional weight portion, showing a first embodiment of a latching mechanism.

FIG. 5 shows a cut through view of the plate 5 in the region of a latch point. As can be seen, the catch member 73*a* is an elongate member with a length extending along a direction perpendicular to the first wall 69 of the shoulder

65*a*, 65*b*. The catch member 73*a* is formed in a hollow passage 75*a* in the additional weight portion 57, extending parallel to the length of the catch member 3*a*, 73*b*. A tip of the catch member 75 projects out through an opening 77 in the first wall 69 of the shoulder 67*a*, 67*b*.

In use, the catch member 73*a* is able to move in a linear direction along its length. In a first positon, as shown in FIG. 5, the catch member 73*a* projects out of the opening into the passage 55 in the socket 43. In a second positon, the catch member 73 is retracted out of the passage 55. This then allows then additional weight portion 57*a* to be removed from the plate 5 in the radial direction, sliding the shoulders 67*a*, 67*b* out of their corresponding sockets. In this way, the additional weight portions 57*a*, 57*b* can be connected and disconnected from the core part 27 of the body 17.

As best shown in FIG. 5, movement of the catch member 73*a* is controlled by a control bar 79*a*. The control bar 79*a* extends from the end of the catch member 73*a* opposite the opening 77 towards the radially outer rim 63 of the additional weight portion 57*a*, 57*b*. A radially outer end of the control bar 79*a* is formed as a handle 81*a*, 81*b*.

The handle 81*a*, 81*b* is formed in a recess 85*a*. 85*b* extending radially inward from the outer rim 63 of the additional weight portion 57*a*, 57*b*. The control bar 79*a* extends from the handle 81*a*, 81*b* to the catch member 73 through a second hollow passage 87 formed in the additional weight portion 57*a*, 57*b*.

Away from the hollow section formed by the first and second passages 75, 87 the additional weight portion 57*a*, 57*b* is solid to provide weight to the plate 5.

As shown in FIG. 5, the control bar 79*a* is biased by a spring 83 to the first position, where the catch member 73 holds the additional weight portion 57*a*, 57*b* in place. Pushing the handle 81*a*, 81*b* withdraws the catch member 73*a* to allow the additional weight portion to be removed.

Each additional weight portion 57*a*, 57*b* is connected to the core part 27 by a pair of latching points on the opposing sidewalls 65*a*, 65*b*. Each of the catch members 73*a*, 73*b* and passages 55 is arranged as discussed above. Therefore, as can be seen from FIG. 4, for example, squeezing together the pair of handles 81*a*, 81*b* fully disconnects the latching points, to allow removal of the additional weight portions 57*a*, 57*b*.

By connecting and disconnecting the additional weight portions 57*a*, 57*b*, the total weight of the plate 5 (and thus the dumbbell 1) can be varied quickly and easily, without having to remove plates 5 from the bar 3.

The minimum weight of each plate 5 is determined by the core part 27, and the weight can be increased incrementally by connecting the additional weight portions 57*a, b*.

In one example, the core part 27 may provide 50% of the maximum weight of the plate, and each of the additional weight portions may provide 25% of the maximum weight. Thus, for example, for a plate 5 with maximum eight of 8 kg, the weight can be varied between 4 kg and 8 kg in increments of 2 kg.

The plate 5 may be made of any suitable material used for plates 5*a*, 5*b* for dumbbells and barbells 1. For example, the plate 5 may be cast iron with or without a coating of plastic or rubber. Where a coating is provided, the coating may be provided on the front surface 11, the rear surface 13 and the annular outer wall 19 of the core part 27. The coating may also be provided on the front surface 11, the rear surface 13 and the annular outer wall 19 of the additional weight portion 57*a*, 57*b*. The radial sidewalls 39*a*, 39*b* of the primary weight portions 35, the radial sidewalls 65*a*, 65*b* of the additional weight portions and the shoulders 67*a*, 67*b* may each be coated or uncoated.

Alternatively, the core part 27 of the body 17 may be made of a rigid plastic shell filled with concrete or other material to provide weight and likewise, the additional weight portions 57*a*, 57*b* may be made of a rigid plastic shell filled with concrete or other material to provide weight.

The additional weight portions 57*a*, 57*b* may be made in two parts, a first part including the front surface 11 and a second part including the rear surface 13. Each of the parts (not shown) may form part of the passage 75 for the catch member 73 and the second passage 87, such that the catch member 73 and control bar 79 may be provided in place, and the additional weight portion assembled around it. The parts may be joined by welding, adhesive, interengaging projections or other suitable engaging means known to the person skilled in the art.

The core part 27 of the body may also be formed of two separate parts, assembled together to form the socket 43 and passage 55 in the socket 43.

Alternatively, the core part 27 may be formed as a single piece, with the socket 43 and passage 55 formed in the radial edges during or after formation of the part 27.

Likewise, the additional weight portion 57*a*, 57*b* may be formed as a single piece, with the passages 75*a*, 87*a* formed during or after formation of the portion 57*a*, 57*b*.

Any suitable production method may be used to form the core part 27 and the additional weight portions 57*a*, 57*b* (and the separate parts thereof, if needed). For example, the parts may be formed by casting, extrusion, 3D printing or the like.

Features such as the socket 43, and passaged 55, 75, 87 may be formed in the production of the parts, or may be formed by post processing using drilling, milling, machining or the like.

In one example, at least the catch member 73 of the latching mechanism should be formed of metal such as steel or iron, to provide the strength and rigidity to hold the additional weight portion 57*a*, 57*b* in place, even when the barbell or dumbbell 1 is dropped. The control bar 79 and handle 81 may be the same material, or different material. At least the handle 81 may be formed with a coating of plastic, optionally with an ergonomic shape, to make them easier to actuate.

The dumbbell or barbell 1 may be provided as a set comprising a bar 3, and one or more pairs of plates 5*a*, 5*b*, the different pairs having different maximum weights. In one example, all the plates 5*a*, 5*b* may have the same radius, but the thickness varies to vary the weight. In other examples, only the radius may vary, or both the radius and thickness may vary.

Colour coding may be used to easily identify different pairs. For example, the handles 81*a*, 81*b*, accent parts of the core part 27 and/or additional weight portions 57*a*, 57*b* or the whole of the core part 27 and/or additional weight portions 57*a*, 57*b* may be colour coded based on the weight.

Each plate 5*a*, 5*b* may have the same incremental variation by the connection/disconnection of additional weight portions. Using the above example, each weight may be variable between 50% and 100% of in maximum weight in 25% increments. In other examples, the relative variation for different plates 5*a*, 5*b* may be different.

Figure 8:
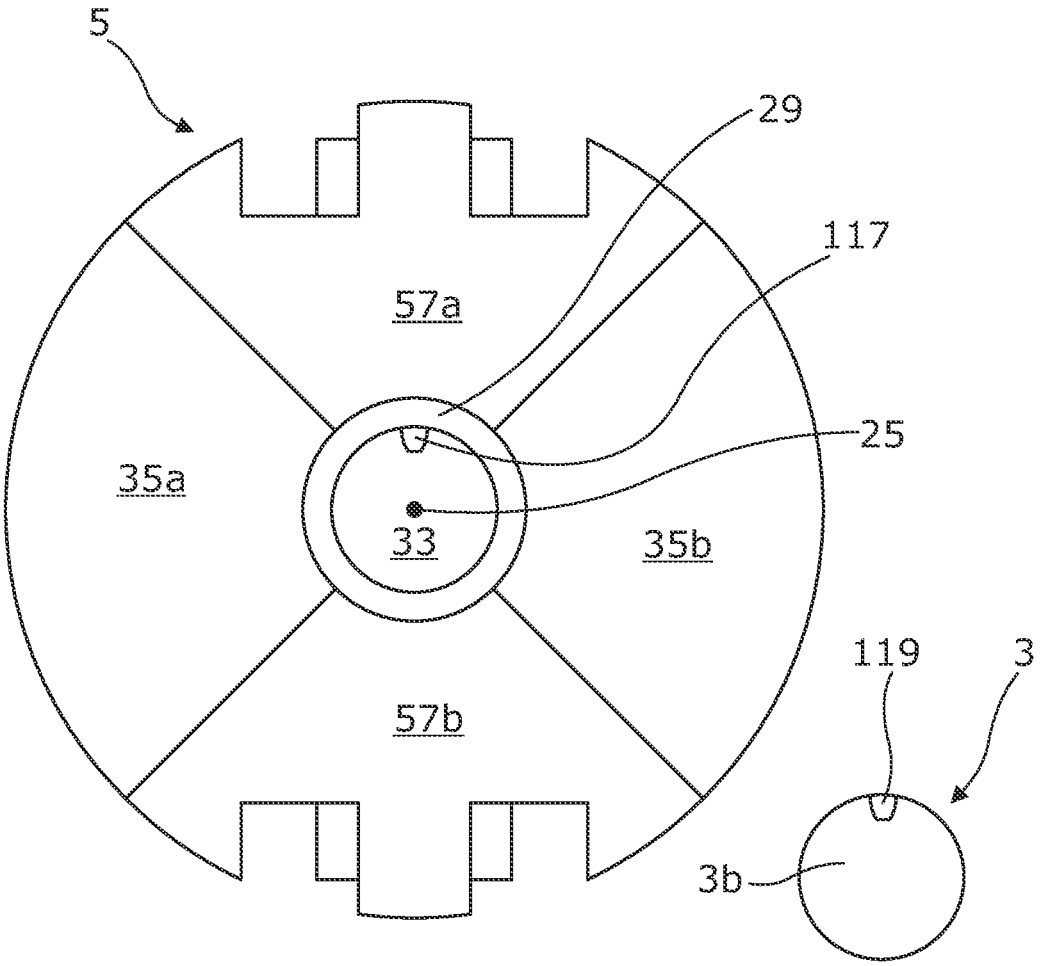
FIG. 8 illustrates a bar according to an embodiment of the invention.

FIG. 8 shows an example of a bar 3 and plate 5 in end on view, showing an optional modification. In this example, the bar 3 and plate 5 are as discussed above, unless explicitly stated otherwise.

In this example, the mounting portion 29 includes a projection 117 extending in a radial direction into the passage 33 for mounting the plate 5. A corresponding groove 119 is formed extending radially inward, on each end portion 3*b*, 3*c* of the bar. The grooves 119 extend the full length of the end portions 3*b*, 4*c*, up to the collars 7*a*, 7*b*, and are aligned with each other around the axial direction.

In some examples, the projection 117 may be formed by a ball bearing received within a hole formed in the mounting portion 29. The ball bearing may be held in place to project out of the hole by a spring or other resilient biased means, In other examples other suitable retracting projections may be used, or the projection may be rigid.

In use, when the plate is mounted 5 on the bar 3, the projection 117 is received inside the groove 119. This engagement prevents rotation of the plate 5 around the bar 3. When the plate 5 is used with a bar 3 without a groove 119, the ball bearing can be pushed back into the mounting portion 29 by the bar 3 so that the plate 5 may still be used.

The projection 117 and groove 119 may be of any suitable shapes, that are discontinuous around the axis, and prevent rotation of the plate 5. In some examples, the projection 117 may be on the bar 3, and the groove 119 on the inside surface of the mounting portion 29 of the plate.

In the examples discussed above, one example of a latching mechanism, used to secure the additional weight portions 57*a*, 57*b* to the core part 27 of the body 17, is described. This is given by way of example only.

In the mechanism discussed above, the control bar 79*a* is rigidly coupled to the end of the catch member 73*a*. However, a variety of suitable linkages, rigid or otherwise, will be apparent to the person skilled in the art to link the handles 81*a* to the catch member 73*a*.

Furthermore, the catch member 73*a* may have any suitable shape and configuration to engage the passage 55 in the socket 43.

Any suitable biasing means may be used to bias the catch member 73 into the passage 55, and the catch member 73 or control bar 73. The catch member 73 may be biased at any location along the length of the catch member 73 or control rod 79. Instead of biasing, a holding mechanism may be provided to hold the catch member at a selected position.

The shoulders 67*a*, 67*b* and sockets 43 provide location of the additional weight portions 57*a*, 57*b* relative to the core part 27 of the body 17, and prevent movement at least along the axial direction 23 and around the axis 23. However, it will be appreciated that the particular shape of the shoulder 67*a*, 67*b* and sockets 43 is shown by example only, and the shoulder 67*a*, 67*b* may have any shape that achieves the same result.

For example, the shoulders 67*a*, 67*b* may have a side extending parallel to the radial sidewalls 65*a*, 65*b* of the additional weight portions 57*a*, 57*b*, with end walls connecting the side of the shoulder 67*a*, 67*b* to the diewall 65*a*, 65*b* of the additional weight portion 57*a*, 57*b*. The socket 43 may be any suitable shape to receive the shoulder 67*a*, 67*b*. Any other suitable shape shoulder may be used.

The catch member 73 may project out of the shoulder 67*a*, 67*b* at any suitable positon. In the example shown, the catch member 73 is formed midway along a side of the shoulder 67*a*, 67*b* and the corresponding passage 55 is formed midway along a side of the socket 43. However, in other examples, the catch member 73 and socket may be at any other suitable positon. For example, the catch member 73 may be formed at a radial end of the shoulder (inner or outer) and the passage 55 formed at a corresponding end of the socket 43.

In some cases, the shoulder 67*a*, 67*b* may be entirely omitted, and only a catch member 73 used to connect the additional weight portion 57*a*, 57*b* to the core part 27.

Figure 6:
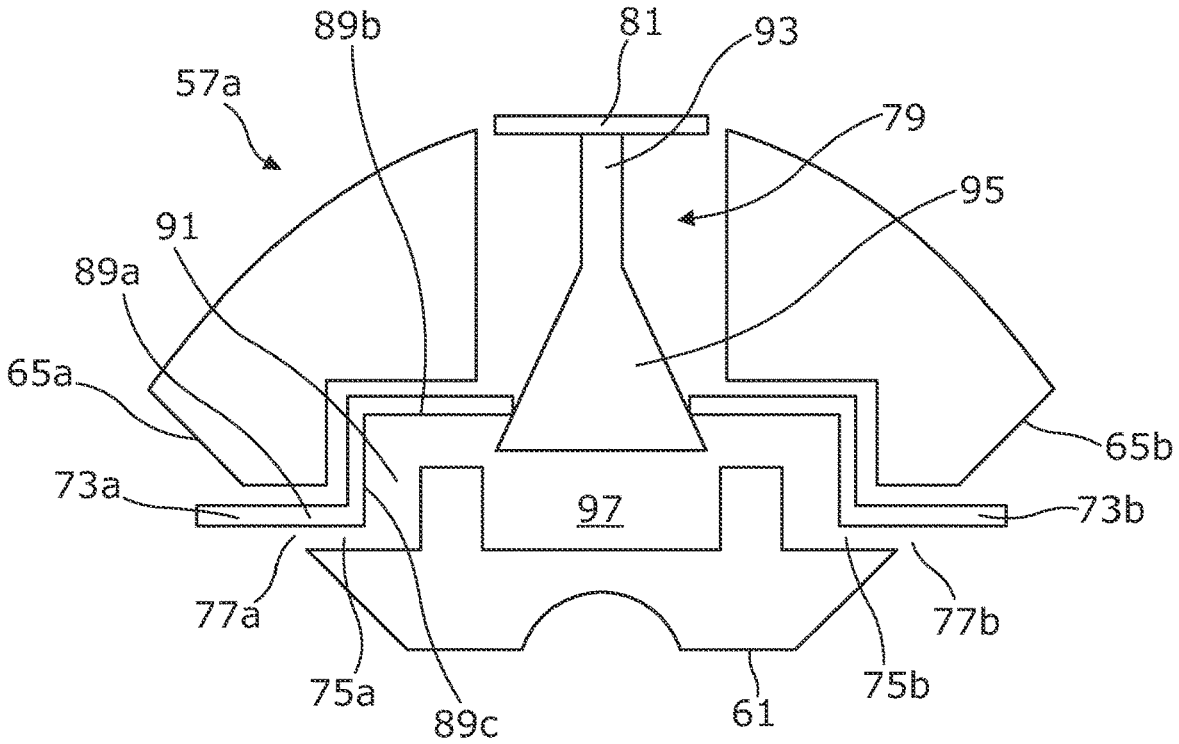
FIG. 6 illustrates a first alternative latching mechanism.

In the examples discussed above, each catch member 73*a*, 73*b* is actuated by a separate handle 81, 81*b*. However, it will be appreciated that a single handle 81 may instead be used. FIG. 6 illustrates one example of how this may be implemented.

In the example shown in FIG. 6, the catch members 73*a*, 73*b* have a dog leg shape, having first and second portions 89*a*, 89*b* extending along a first direction. The first and second portions 89*a*, 89*b* and spaced from each other perpendicular to the first direction and are joined by a third portion 89*c*, extending in the direction perpendicular to the first and second portions 89*a*, 89*b*.

The passages 75*a*, 75*b* have a corresponding shape to the catch members 73*a*, 73*b*; however, the perpendicular section 91 of the passage 75*a*, 75*b* corresponding to the third portion 89*c* of the catch member 73*a*, 73*b*, is wider than the catch member 73*a*, 73*b*, to allow the catch member 73*a*, 73*b* to move back and forth along the first direction.

In a first configuration, the end of the catch member 73*a* projects out of the opening 77*a*, 77*b* in the sidewall 65*a*, 65*b* of the additional weight portion 57*a*, 57*b*. This engages a passage 55 in the primary weight portions 35*a*, 35*b* to form a latching point.

In the example shown in FIG. 6, a single central control bar 79 is provided extending in the radial direction. The catch members 73*a*, 73*b* are separate from the control bar 81. A button 81 is located at the top (radially outer end) of the control bar 79. The control bar 79 has a narrow stem 93 extending from the button 81, and then a wider base portion 95 at the opposite (radially inner) end to the button 81. The wider base portion 95 tapers outwards as it extends away from the stem 93.

As shown in FIG. 6, in the first configuration, the wider base portion 95 engages the catch members 73*a*, 73*b* to push them outwards, out of the openings 77*a*, 77*b*. A space 97 is formed in the additional weight portion 57*a*, below the wider base portion 95 of the control rod 79. The space is provided towards the radially inner rim 61 of the additional weight portion 57*a*. As the button 81 is pushed down, in the radial direction, the wider base portion 95 moves into the space 97. The catch members 73*a*, 73*b* are resiliently biased inwards towards each other by a spring or other biasing means. Therefore, in a second configuration, the catch members 73*a*, 73*b* move in to engage the stem 93, meaning the ends of the catch members 73*a*, 73*b* no longer project out of the passages 75*a*, 75*b*, and the additional weight portion 57 can be removed.

The button 81 and/or control bar 79 is biased to a positon where the wider base portion 95 engages the catch members 73*a*, 73*b*. The biasing of the button 81 and/or control bar 79 is such that it overcomes the biasing of the catch member 73*a*, 73*b* without input from a user on the button 81. Therefore, releasing the button 81 causes the control bar 79 to revert to the position shown in FIG. 6, in which the catch members 73*a*, 73*b* are pushed outwards, out of the openings 77*a*, 77*b*

It will be appreciated that in other examples, the control bar 79 may include an enlarged portion near the button 81 and a narrow portion away from the button 81. For example, the enlarged portion may be diamond shaped. In this case, the catch members 73*a*, 73*b* project out of the openings 77*a*, 77*b* (first configuration) when the control rod is moved inwards along the radial direction, and received within the additional weight portion 57 (second configuration) when the button is moved outwards along the radial direction. In this case, the control bar 79 is again biased to the first configuration.

The dog leg shape of the catch member 73*a*, 73*b* shown in FIG. 6 is by way of example only. The catch member 73*a*, 73*b* may adopt any suitable shape that allows it to engage the control bar 79, project through the opening 77*a*, 77*b* and be resiliently biased as required.

As discussed above, where separate buttons 81*a*, 81*b* are provided for each catch member 73*a*, 73*b*, any suitable mechanism may be used to link the control bar 79*a*, 79*b* to the catch member 73*a*, 73*b*. It will be appreciated that the control bar 79 of FIG. 6, with an enlarged portion 95 and narrow stem 93, may be used in embodiments with two separate handles 81*a*, 81*b*. In this case, the control bar 79*a*, 79*b* may be asymmetrical about the radial direction.

Figure 7A:
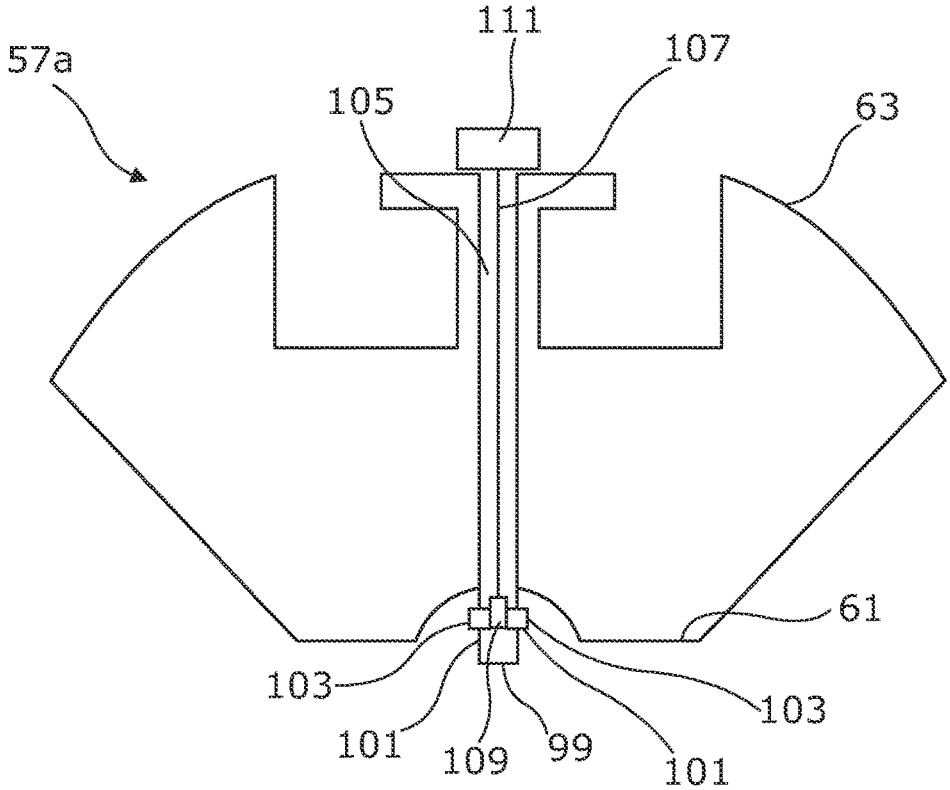
FIG. 7A illustrates a second alternative latching mechanism.
Figure 7B:
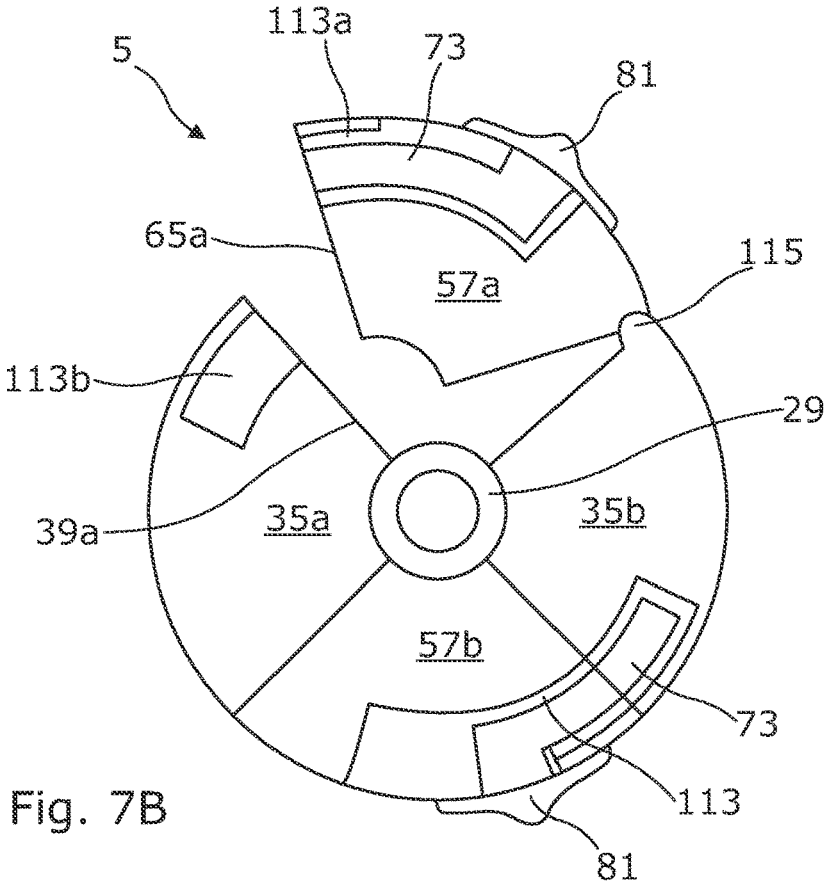
FIG. 7B illustrates a third alternative latching mechanism.

FIGS. 7A and 7B Show alterative examples of how the additional weight portions 57*a*, 57*b* may be connected to and disconnected from the core part 27 of the body 17. Unless explicitly stated otherwise, the embodiments shown in FIGS. 7A and 7B are the same as the embodiment discussed above.

FIG. 7A shows an example of connecting additional weight portions 57*a*, 57*b* using a ball lock pin type mechanism.

In the example shown in FIG. 7A, a projection 99 is formed extending in a radial direction from the radial inner edge 61 of the additional weight portion 57*a*. The projection has a pair of radial projecting openings 101 through which ball bearing 103 or other formations project.

Within the additional weight portion 57*a*, a passage 105 extends radially from the radial outer rim 63 to the inner rim 61, extending into the projection 99. A shaft 107 with an enlarged end 109 extends through the passage 105, with a button 111 at the top.

In use, the projection 101 is received in a corresponding passage (not shown) of the mounting portion 29. The enlarged end 109 of the shaft engages the ball bearings 103 to force them out of the openings 101. The ball bearings 103 engage with corresponding recesses (not shown) in the side of the passage, to retain the additional weight portion 57*a*.

Pressing the button 111 causes the shaft 105 to slide in the radial direction, such that the enlarged end 109 disengages from the ball bearings 103. This retracts the ball bearings 103 from the recesses so that the additional weight portion 57*a* can be removed. As in the examples discussed above, the shaft 105 may be resiliently biased such that the ball bearings 103 project out of the openings 101.

As shown in FIG. 7A, the additional weight portion 57*a* include handles 81*a*, 81*b* formed in the outer rim 63, with corresponding handle recesses 85 to make for an ergonomic shape. These are separate to the button 111 for actuating the ball lock pin mechanism.

Although the example shown in FIG. 7A does not include the shoulders 67*a*, 67*b* of the additional weight portion 57*a*. It will be appreciated that the mechanism shown in FIG. 7B illustrates a further example of a latching mechanism that may be used to connect the additional weight portions 57 to the core part 27 of the body 17.

In the example shown in FIG. 7B, the catch member 73 is arc shaped, and extends in a correspondingly shaped 113 in the body 17 of the plate 5. The arc shaped passage has a first portion 113*a* formed in the additional weight portion 57*a* and opening out of one of the radial sidewalls 65*a* of the additional weight portion 57*a*, 57*b*. A second portion 113*b* of the passage is formed in the adjacent primary weight portion 35*a*, 35*b*. The second portion 113*b* of the passage opens out of the radial sidewall 39*a* of the primary weight portion 35*a*, 35*b*. The two portions 113*a*, 113*b* of the arc shaped passage 113 align when the additional weight portion 57*a*, 57*b* is fitted into the void 37*a*, 37*b* in the core part 27, such that a single continuous passage is formed.

The catch member 73*a*, 73*b* is able to slide in the passage 113, by actuation of a handle 81. In a first configuration, the catch member 73*a*, 73*b* extends through both portions of the passage 113*a*, 113*b*, holding the additional weight portion 57*a*, 57*b* in place. In a second configuration, the catch member 73*a*, 73 is received solely in the first portion 113*a* of the passage, such that the additional weight portion 57*a*, 57*b* can be removed.

As in the examples discussed above, the catch member 73*a* can be resiliently biased to hold the additional weight portion 57*a*, 57*b* in place.

In the example shown in FIG. 7B, a single catch member is provided, extending out of a first side 65*a* of the additional weight portion 57*a*, 57*b*. At the opposite side 65*b*, a retaining lip 115 is provided to engage the additional weight portion 57*a*, 57*b* in place. Alternatively, a pair of catch members 73*a*, 73*b* extending out of each side 65*a*, 65*b* of the additional weight portion 57*a*, 57*b* may be provided.

Figure 7C:
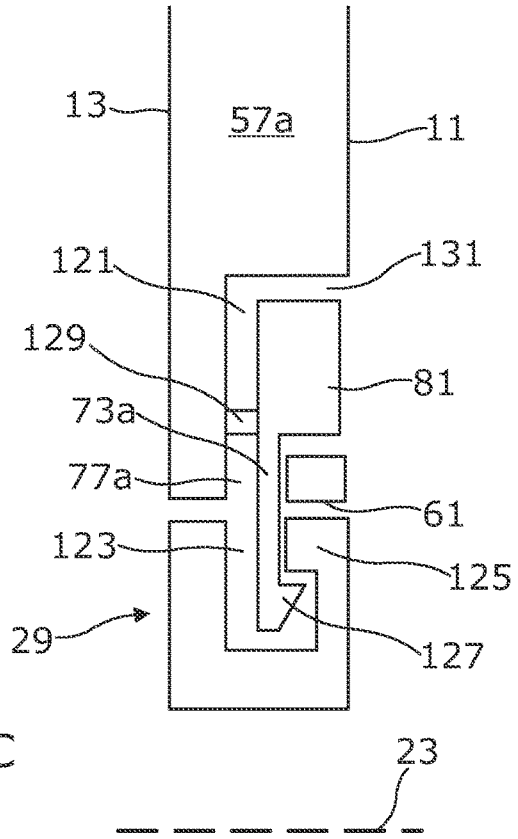
FIG. 7C illustrates a fourth alternative latching mechanism.

FIG. 7C illustrates yet a further example of a latching mechanism that may be used to connect the additional weight portions 57*a* to the core part 27 of the body 17. FIG. 7C illustrates the latching mechanism in sectional view, side on through the plate 5. Unless explicitly stated otherwise, the embodiments shown in FIG. 7C is the same as the embodiment discussed above.

In this example, the catch member 73*a* extends in a radial direction, through a radially extending passage 121 and out of an opening 77*a* in the inner rim 61 of the additional weight portion 57*a*.

The mounting portion 29 includes a corresponding passage 123 extending in a radial direction, for receiving the catch member 73.

At a radially outer end of the passage 123 in the mounting portion 29, a ledge 125 extends into the passage 123. The end of the catch member 73 includes a corresponding protrusion 127. In use, the protrusion 127 engages the ledge 125 to prevent the additional weight portion 57*a* being removed in the radial direction.

The catch member 73*a* is able to move in the axial direction 23, within the passages 121, 123 in the additional weight portion 57*a* and mounting portion 29. Movement of the catch member 73 can disengage the ledge 125 and protrusion 127, allowing the additional weight portion 57*a* to be removed.

A spring 129 or other biasing means resilient biases the catch member 73*a* so that the protrusion 127 engages the ledge 125. A handle 81 is provided at the end of the catch member 73 opposite the protrusion 127, to allow actuation of the movement of the catch member 73. The handle 81 projects through an aperture 131 formed in the front surface 11 of the plate 5.

In the example shown in FIG. 7C, the handle 81 is provided near the radially inner edge of the additional weight portion 57*a*. However, this is by way of example only. The handle 81 may be provided at any position between the inner rim 61 and outer rim 63, or in a recess formed at the outer rim 63.

In the examples shown in FIG. 7C, the handle 81 projects out of the front surface 11 of the plate 5. However, this need not be the case, and the handle 81 may project from the rear surface 13.

In FIG. 7C, a single ledge 125 is provided in the mounting portion, on the side of the passage 123 towards the front surface 11 of the plate 5. In other examples, ledges 125 may be provided on both sides of the passage 123, and two separate catch member 73*a*, 73*b* may be provided, with protrusions 127 extending in opposite axial directions, such that one engages the ledge 125 at the front surface 11 and the other engages the edge 125 at the rear surface 13. The catch member 73 engaging the ledge 125 at the front surface 11 will have a handle 81 on the front surface 11 of the plate 5, whilst the other catch member 73 will have a handle 81 on the rear surface 13 of the plate 5. The catch members 73 can be moved inwards, towards each other, to disengage the protrusions 127 from the ledges 125.

In one example using the latching mechanism shown in FIG. 7C, there may be a single catch member 73, protrusion 127 and ledge 125 extending for around the width of the additional weight portion 57*a*. This may extend around any proportion of the width of the additional weight portion.

In other examples, there may be a number of catch members 73 spaced around the width of the additional weight portion 57*a*. The ledge 125 may still extend around the width of the additional weight portion 57*a*, or there may be a number of spaced ledges 125, corresponding to the catch members 73. The catch members 73 may all extend from a single handle 81 such that they are all actuated at the same time. Alternatively, each catch member may have a separate handle 81.

In the example shown in FIG. 7C, the ledge 125 for engaging the protrusion 127 on the catch member 73 is formed in the interior of the mounting portion 29. However, in other examples, the ledge may be formed by an aperture (not shown) extending through the front of the mounting portion 29. In use, the protrusion 127 will then project through the aperture.

FIGS. 6, 7A, 7B and 7C do not show using shoulders 67*a*, 67*b* and sockets 43 as a locating mechanism. It will be appreciated that the mechanisms shown in FIGS. 6, 7A and 7B may be used with shoulders 67*a*, 67*b*, in a similar manner to the mechanism shown in FIG. 5, or without shoulder 67*a*, 67*b*.

The embodiments shown in FIGS. 5, 6, 7A, 7B and 7C are given by way of example only. Various other latching mechanisms will be apparent to the person skilled in the art. For example, the additional weight portion 57*a*, 57*b* may be held in place by snap fit projections at the radial sidewalls 65*a*, 65*b* and/or inner rim 61 of the additional weight portion, over centre latches on the front/rear face 11, 13 of the body 17, or on the outer rim 21 of the body 17 or other types of latches. Alternatively, the catch members 73 may have hook formations at the end, which engage with corresponding projections on the core part 27 of the body 17 (either in the mounting portion 29 or the primary weight portions 35*a*, 35*b*). Magnets may be used to hold and/or locate the additional weight portions 57*a,b*.

Alternatively, threaded bolts or projections and corresponding threaded holes may be used, extending radially or in any other direction.

In the latching mechanisms shown in FIGS. 5 and 6, catch members 73*a*, 73 project from both sides 65*a*, 65*b* of the additional weight portion 57*a*, 57*b*. However, this need not necessarily be the case. In some cases, a catch member 73 may project from a single side, with a retaining lip on the other side, as shown in FIG. 7B.

In the latching mechanisms shown in at least FIGS. 5 and 6, the same handle 81 is used for actuating the latching mechanism and lifting the additional weight portion 57*a*. However, this need not be the case. In other examples, separate handles and actuating buttons/triggers may be provided. The actuating buttons and/or handles may be formed at the radially outer edge 63 as shown in the Figures, or on either the front or rear surface 11, 13 of the plate 5.

In the latching mechanisms shown in 5, 6, 7A and 7B, the catch member 73 or retaining member (ball bearings 103) moves in a direction perpendicular to the thickness of the plate 5. However, this need not necessarily be the case, and the catch member 73 may be along the axial direction of the plate, as shown in FIG. 7C. FIG. 7C is just one example of this type of latching mechanism, In the examples discussed above in relation to FIGS. 5, 6 and 7B, the additional weight portions 57*a*, 57*b* connect to the core part 27 at latching points along the radial sidewalls 39*a*, 39*b* of the primary weight portions 35*a*, 35*b*. In some examples, one, two or more connection points may be provided along each sidewall 39*a*, 39*b*, all actuated by the same handle 81*a*, 81*b* or different handles 81*a*, 81*b*.

In further examples, as shown in FIGS. 7A and 7C, a connection point may be provided between the radially inner rim 61 of the additional weight portion 57*a*, 57*b* and the mounting portion 29 The person skilled in the art will appreciate that the connection techniques discussed above in relation to FIGS. 5, 6 and 7B can be adapted for use at a connection point at the mounting portion 29. For example, the shoulders 67 may extend into a socket 43 in the mounting portion 29, and the catch member 73 may project out of the side of the shoulder into a passage in the mounting portion.

In further examples, latching mechanisms may be provided around the outer rim 21 of the plate 5.

In at least some of the mechanisms discussed above, the latching mechanism is biased so that the catch member 73 is only withdrawn into the passage 75*a*, 75 with input of force from a user. It may be that the latching mechanism includes locking means to hold the catch in the withdrawn position. Alternatively, the latching mechanism may be biased to withdraw the catch members 73*a*, 73*b*, and the locking mechanism may be engageable to hold the catch members 73*a*, 73*b* against the biasing when they are needed to hold the additional weight portion 57*a*, 57*b* in place. Alternatively, the biasing may be omitted and only a locking mechanism used.

It will be appreciated that an additional weight portion 57*a*, 57*b* may be connected to a primary weight portion at a combination of different positions (for example at the sidewalls and the mounting portion).

In some embodiments, different connection/latching mechanisms can be used to connect the additional weight portions 57*a*, 57*b* to the core part 27 at different connection/latching points. For example, at the sides 65*a,b* of the additional weight portions 57*a*, latches such as shown in FIG. 5 may be used, and a ball lock pin type mechanism may be used to connect to the mounting portion 29.

In the examples, discussed above in relation to FIG. 1 to 6, 7A and 7B, the handles 81 for connecting and disconnecting the additional weight portions 57*a*, 57*b* are formed in recesses 85 in the outer rim 63. This need not necessarily but the case, and the handles 81*a*, 81*b* may be provided radially outside the outer rim 63. In the examples showing recess 85, the recesses are open through the thickness of the body 17. However, this also need not be the case, and the recesses may be closed at the front and/or rear face 11, 13 of the plate 5. Alternatively, as shown in FIG. 7C, the handles may be formed on the front or rears surfaces 11, 13 of the plate 5.

In the latching mechanisms discussed above, both the shoulders 57*a*, 57*b* (where shown) and the catch members 73*a*, 73*b* are on the additional weight portion 57*a*, 57*b*, and the sockets 43 and passages 55 are in the primary weight portions 35*a*, 35*b*. In other examples, the primary weight portion 35*a*, 35*b* may comprise the shoulders 57*a*, 57*b* (where included) and catch member 73, and the additional weight portion 57*a*, 57*b* may comprise the socket 43 and passage 55. In other examples, one of the primary weight portion 35*a*, 35*b* and additional weight portion 57*a*, 57*b* may comprise the socket 43, with a catch member 73 projecting out of the socket wall in to the socket 43. The other of the primary weight portion 35*a*, 35*b* and additional weight portion 57*a*, 57*b* may comprise the shoulder 67*a*, 67*b* and a passage for receiving the catch member 73.

In the example, discussed above, the plate 5 has a pair of primary weight portions 35*a*, 35*b*, each extending around an arc of 90 degrees around the plate axis 23, and a pair of additional weight portions 57*a*, 57*b*, each also extending around an arc of 90 degrees around the plate axis 23.

This configuration is given by way of example only. Any suitable configuration may be used.

For example, the primary weight portions 35*a*, 35*b* may extend for more or less than 90 degrees. This causes a corresponding change in the size of the voids 37*a*, 37*b* between the primary weight portions 35*a*, 35*b*, resulting in a corresponding change in the angle which the additional weight portions 57*a*, 57*b* extend around.

In the example discussed above, the core part 27 provides 50% of the maximum weight, and each of the additional weight portions 57*a*, 57*b* provides 25% of the weight. This need not necessarily be the case. For example, the core may be 60% of the maximum weight, with the additional weight portions 57*a*, 57*b* each being 20%. Any other split of the weight is also possible. Table 1 shows some examples of weight variations possible for a plate 5:

TABLE 1 example weight combinations for a single plate

| | Weight of core part | Weight of each additional weight portion | Possible weights for the plate |
|---|---|---|---|
| Combination 1 | 2 kg | 1 kg | 2 kg, 3 kg, 4 kg |
| Combination 2 | 4 kg | 2 kg | 4 kg, 6 kg, 8 kg |
| Combination 3 | 5 kg | 2.5 kg | 5 kg, 7.5 kg, 10 kg |
| Combination 4 | 6 kg | 3 kg | 6 kg, 9 kg, 12 kg |
| Combination 5 | 8 kg | 4 kg | 8 kg, 12 kg, 16 kg |
| Combination 6 | 5 kg | 2 kg | 5 kg, 7 kg, 9 kg |

In the examples where the core part 27 provides 50% of the maximum weight, and each of the additional weight portions 57*a*, 57*b* provides 25% of the weight, the additional weight portions 57 may extend for more than 90 degrees around the arc, to ensure they are of the required weight, and to accommodate the hollow spaces required for the latching mechanisms.

In some examples, more than two primary weight portions 35*a*, 35*b* and additional weight portions 57*a*, 57*b* may be provided. For example, three, four, five or more primary weight portions 35*a*, 35*b* may be provided, spaced from each other around the plate axis 23, with voids 37*a*, 37*b* formed in the spaces. In each void 37*a*, 37*b* formed between two primary weight portions 35*a*, 35*b*, an additional weight portion 57*a*, 57*b* may be provided, connected to the neighbouring primary weight portions 35*a*, 35*b* on either side by latching mechanisms, as discussed above.

Conversely, only a single primary weight portion 35 may be provided, with a single void 37 to receive a single additional weight portion.

In the examples discussed above, the primary weight portions 35*a*, 35*b* and additional weight portions 57*a*, 57*b* are in the form of annulus sectors extending from the mounting portion 29 to the radially outer rim 21 of the body 17. This need not necessarily be the case.

For example, two or more additional weight portions 57*a*, 57*b* may be connectable in each void 37*a*, 37*b*. Each additional weight portion 57*a*, 57*b* may be an annulus sector, may only extends a part of the radial distance from the mounting portion 29 to the outer rim 21. Each portion may then have latching mechanisms as described above.

In other examples, the general shape of the additional weight portion 57*a*, 57*b* may be different. For example, the sides of the additional weight portion may be parallel.

Furthermore, the inner rim 61 of the additional weight portion 57*a*, 57*b* may be straight rather than curved. The voids 37*a*, 37*b* in the core part may then be of corresponding shape.

In some examples, the primary weight portion 35*a*, 35*b* may extend all the way around the plate axis 23, with voids 37, 37*b* formed for receiving one or more additional weight portions 57*a*, 57*b*. The voids 37*a*, 37*b* may be open to the outer rim 21 of the body 27, to allow the additional weight portions 57*a*, 57*b* to be removed in a radial direction. Alternatively, the voids 37*a*, 37*b* may be entirely enclosed by the primary weight portion(s) 35*a*, 35*b*, such that the additional weight portions 57*a*, 57*b* are removed along the axial direction. The voids 37*a*, 37*b* and additional weight portions 57*a*, 57*b* may be any suitable corresponding shape.

In yet further examples, the additional weight portions 57*a*, 57*b* may be arranged concentrically, around the outside the primary weight portion 35*a*, 35*b*. In this case, the primary weight portion 35*a*, 35*b* may not form voids at all, or voids may be formed in radially extending recesses. Where no voids are formed, the additional weight portion may be made of a single annular additional weight portion 57, or a plurality of annular sectors.

In the examples discussed above, the additional weight portions 57*a*, 57*b* in a single plate 5 are the same weight as each other. This need not necessarily be the case.

Furthermore, in the example discussed above, the mounting portion 29 is annular and extends the full way round the plate axis. This need not be the case, and any suitable method for mounting the plate 5 onto a bar may be used. Similarly, the person skilled in the art will be aware of a variety of different shapes the plate 5 and bar may adopt. For example, the plates 5 may be square, or have flat sections, and the bar may be shaped for ergonomic use. In the case of alterative shaped plates, the additional weight portions 57 may be connectable to the edges of the plate, or in any other way as discussed above. The bar 3 may omit the collar 7*a*, 7*b* and retain the plates in other ways. For example, an end of the groove 119 shown in FIG. 8 may be used to prevent the plate 5 encroaching on the centre of the bar 3.

In the example discussed above, the mounting portion 29 projects out from the front and rear surfaces 11, 13 of the plate 5, such when two plates 5 are next to each other on the bar 3, the plates 5 are spaced from each other. This makes it easier for a user to access the handles 81*a*, 81*b* to connect and disconnect additional weight portions 57*a*, 57*b*, and make it easier for the additional weight portions 57*a*, 57*b* to slide in and out of the voids 37*a*, 37*b*. It will be appreciated that the spacing between plates 5 may be achieved by any suitable formations or projections extending out from the front and rear surfaces 11, 13 of the plate 5. For example, the rim 21 may include projections instead of or as well as the mounting portion 29. Alternatively, the plates may be flat, such that they are not spaced when placed adjacent to each other.

In the examples discussed above, the plate is removable from the bar. However, it will be appreciated that the core part 27 of the body 17 may be permanently fixed to the bar 3. In such cases, the collar 7*a*, 7*b* may be omitted.

The invention claimed is:

1. A plate for a dumbbell or barbell, the plate comprising a body, the body comprising:

at least two primary weight portions extending in a direction radially out from a plate axis passing through a centre point of the plate, the at least two primary weight portions forming at least part of a total weight of the plate; and two or more additional weight portions removably connectable to the body, such that connecting and disconnecting the two or more additional weight portions incrementally varies the total weight of the plate, the body further comprising:

for each of the two or more additional weight portions, a void arranged to receive the respective additional weight portion, the void defined by the at least two primary weight portions;

wherein the at least two primary weight portions are spaced from each other around the plate axis, each void formed in a space between two of the at least two primary weight portions.

2. The plate as claimed in claim 1, comprising a latching mechanism to removably connect the two or more additional weight portions to the body, the latching mechanism comprising:

one or more catch members, and a corresponding passage to receive of the one or more catch members, each of the one or more catch members and the corresponding passage forming a latching point, the plate optionally comprising biasing means to urge the one or more catch members to remain in the corresponding passage.

3. The plate as claimed in claim 2, wherein the one or more catch members move into and out of the corresponding passage in a first direction into the corresponding passage, the first direction being perpendicular to the plate axis.

4. The plate as claimed in claim 3, wherein the corresponding passage is larger than the one or more catch members in a direction perpendicular to the first direction, to accommodate relative movement of the two or more additional weight portions and the at least two primary weight portions.

5. The plate as claimed in claim 2, comprising handles arranged to actuate the one or more catch members, the handles formed on a radially outer edge of the two or more additional weight portions or the at least two primary weight portions.

6. The plate as claimed in claim 5, wherein the handles are formed in recesses extending radially inwards from the radially outer edge of the two or more additional weight portions or the at least two primary weight portions.

7. The plate is claimed in claim 2, wherein the one or more catch members are provided in a hollow section formed in a primary weight portion of the at least two primary weight portions or an additional weight portion of the two or more additional weight portions, and projects out of an opening to engage the corresponding passage, and wherein the primary weight portion of the two or more additional weight portions having the one or more catch members also comprises solid sections to provide weight.

8. The plate as claimed in claim 2, further comprising locating means arranged to locate the two or more additional weight portions relative to the at least two primary weight portions, the locating means comprising a shoulder extending from one of the at least two primary weight portions and the two or more additional weight portions, and a socket for receiving the shoulder in the other of the primary weight portion and the additional weight portion.

9. The plate as claimed in claim 1, wherein the body comprises:

a mounting portion defining a passage extending around the plate axis, for mounting the plate on a dumbbell bar or barbell bar, the at least two primary weight portions extending radially out from the mounting portion.

10. The plate as claimed in claim 9, wherein a radially inner rim of each of the two or more additional weight portions abuts the mounting portion.

11. The plate as claimed in claim 1 wherein:

each primary weight portion of the at least two primary weight portions comprises a pair of opposing sidewalls each having a length extending radially out from the plate axis; and for each void, a first radially extending edge of the void is formed by a sidewall of the pair of opposing sidewalls of a first primary weight portion of the at least two primary weight portions, and a second radially extending edge of the void is formed by a sidewall of the pair of opposing sidewalls of a second primary weight portion of the at least two primary weight portions, the second primary weight portion of the at least two primary weight portions adjacent to and spaced from the first primary weight portion of the at least two primary weight portions.

12. The plate as claimed in claim 11, wherein:

each void has a width measured around the plate axis, between the first radially extending edge and the second radially extending edge of the void;

each primary weight portion of the at least two primary weight portions has a width measured around the plate axis, between the pair of opposing sidewalls of the primary weight portion;

the voids have the same width as each other; and the at least two primary weight portions have the same width as each other.

13. The plate as claimed in claim 1, wherein the two or more additional weight portions are arranged to be removably connectable to the body by latching points formed, at least in part, in the at least two primary weight portions.

14. The plate as claimed in claim 1, wherein each additional weight portion of the two or more additional weight portions comprises a pair of opposing sidewalls; and wherein each additional weight portion of the two or more additional weight portions is removably connectable to the at least two primary weight portions at both sidewalls of the pair of opposing sidewalls.

15. The plate as claimed in claim 1, wherein the at least two primary weight portions comprise only primary weight portions arranged on opposing sides of the plate axis, and the voids to receive the two or more additional weight portions are arranged on the opposing sides of the plate axis, between the primary weight portions.

16. The plate as claimed in claim 1, wherein each void is open to a radially outer rim of the body to allow the two or more additional weight portions to be removed and inserted in a radial direction.

17. The plate as claimed in claim 1, wherein the two or more addtional weight portions and the at least two primary weight portions are evenly distributed around the plate axis.

18. A dumbbell or barbell kit comprising:

one or more pairs of plates, each plate in a pair having an equal weight to the other plate, wherein each plate comprises a body, the body comprising:

at least two primary weight portions extending in a direction radially out from a plate axis passing through a centre point of the plate, the at least two primary weight portions forming at least part of a total weight of the plate; and two or more additional weight portions removably connectable to the body, such that connecting and disconnecting the two or more additional weight portions incrementally varies the total weight of the plate, the body further comprising:

for each of the two or more additional weight portions, a void arranged to receive the respective additional weight portion, the void defined by the at least two primary weight portions;

wherein the at least two primary weight portions are spaced from each other around the plate axis, each void formed in a space between two of the at least two primary weight portions; and a bar for mounting the one or more pairs of plates on, wherein the plate axis of each plate extends along the bar when the plate is mounted on the bar.

19. The dumbbell or barbell kit as claimed in claim 18, comprising:

the one or more pairs of plates comprising at least two pairs of plates, each plate in a pair of plates being the same weight, and different pairs of plates having different weights from other pairs, wherein:

each plate of the one or more pairs of plates has a thickness along the plate axis and a radius extending from the plate axis;

all plates of the at least two pairs of plates have the same radius; and different pairs of plates have different thicknesses.

20. The dumbbell or barbell kit as claimed in claim 18, wherein the body of the each plate comprises: a mounting portion defining a passage extending around the plate axis, for mounting the plate on a dumbbell bar or barbell bar, the at least two primary weight portions extending radially out from the mounting portion, wherein a projection extends radially into the passage of the mounting portion, wherein the projection is discontinuous around the plate axis and is configured to engage a corresponding groove in the dumbbell bar or barbell bar such that engagement of the projection and groove prevents rotation of the plate around the axis.

* * * * *